US012584660B2

(12) United States Patent
Norbeck et al.

(10) Patent No.: US 12,584,660 B2
(45) Date of Patent: Mar. 24, 2026

(54) ENHANCED GEOTHERMAL SYSTEM

(71) Applicant: Fervo Energy Company, Houston, TX (US)

(72) Inventors: Jack Norbeck, Golden, CO (US); Timothy Latimer, Houston, TX (US)

(73) Assignee: Fervo Energy Company, Houston, TX (US)

( * ) Notice: Subject to any disclaimer, the term of this patent is extended or adjusted under 35 U.S.C. 154(b) by 0 days.

(21) Appl. No.: 18/667,909

(22) Filed: May 17, 2024

(65) Prior Publication Data

US 2025/0027687 A1 Jan. 23, 2025

Related U.S. Application Data

(60) Provisional application No. 63/527,289, filed on Jul. 17, 2023.

(51) Int. Cl.
*F24T 10/20* (2018.01)
*E21B 43/267* (2006.01)

(52) U.S. Cl.
CPC ..... *F24T 10/20* (2018.05); *E21B 43/267* (2013.01)

(58) Field of Classification Search
CPC ..... E21B 43/26; E21B 43/2667; F24T 10/00; F24T 10/20; Y02E 10/10; F03G 4/026
See application file for complete search history.

(56) References Cited

U.S. PATENT DOCUMENTS

| | | | | |
|---|---|---|---|---|
| 5,685,362 | A * | 11/1997 | Brown | F24T 10/20 165/45 |
| 9,057,261 | B2 | 6/2015 | Walters et al. | |
| 11,434,740 | B1 | 9/2022 | Ngyuen et al. | |
| 2009/0038795 | A1* | 2/2009 | Kaminsky | E21B 43/267 166/266 |
| 2012/0198844 | A1 | 8/2012 | Kaminsky | |
| 2013/0000908 | A1* | 1/2013 | Walters | E21B 43/263 166/299 |
| 2015/0129203 | A1* | 5/2015 | Deutch | E21B 43/11 166/250.1 |
| 2016/0042272 | A1* | 2/2016 | Mohaghegh | G06N 3/08 706/19 |

(Continued)

FOREIGN PATENT DOCUMENTS

| | | |
|---|---|---|
| WO | 2019119116 | 6/2019 |
| WO | 2025019064 | 1/2025 |

OTHER PUBLICATIONS

"International Application Serial No. PCT US2024 030250, International Search Report mailed Sep. 3, 2024", 4 pgs.

(Continued)

*Primary Examiner* — Loren C Edwards
(74) *Attorney, Agent, or Firm* — Schwegman Lundberg & Woessner, P.A.

(57) ABSTRACT

Systems and techniques may be used to operate an enhanced geothermal system (EGS). An example technique may include applying a stimulation treatment including a proppant to generate a distributed network of fractures along wellbores between a horizontal geothermal injection well and a horizontal geothermal production well. The horizontal geothermal injection well and the horizontal geothermal production well may be positioned within a mixed metasedimentary and igneous formation.

20 Claims, 16 Drawing Sheets

(56) References Cited

U.S. PATENT DOCUMENTS

2023/0076219 A1 3/2023 Fleckenstein

OTHER PUBLICATIONS

"International Application Serial No. PCT US2024 030250, Written Opinion mailed Sep. 3, 2024", 4 pgs.
Norbeck, Jack, "Commercial-scale demonstration of a first-of-a-kind En-hanced Geothermal System", Fervo Energy, (2023), 15 pgs.

* cited by examiner

Injector Well 34A-22 Pump Schedule

| Stage No. | Stage Name | Pump Rate (bbl/min) | Fluid Type | Clean Volume (bbl) | Well Head Prop Conc. (ppg) | Stage Prop (lbs.) | Stage Time (min) |
|---|---|---|---|---|---|---|---|
| 1 | Injection | 10 | Slickwater | 95 | 0 | 0 | 10 |
| 2 | Acidize | 10 | 15% HCL | 24 | 0 | 0 | 2 |
| 3 | Displacement/Pad | 100 | Slickwater | 1,071 | 0 | 0 | 11 |
| 4 | 100 mesh | 100 | Slickwater | 1,429 | 0.25 | 15,000 | 14 |
| 5 | 100 mesh | 100 | Slickwater | 1,429 | 0.5 | 30,000 | 14 |
| 6 | 100 mesh | 100 | Slickwater | 1,429 | 1 | 60,000 | 14 |
| 7 | 100 mesh | 100 | Slickwater | 1,310 | 1.25 | 68,750 | 13 |
| 8 | 100 mesh | 100 | Slickwater | 1,310 | 1.35 | 74,250 | 13 |
| 9 | 100 mesh | 100 | Slickwater | 1,248 | 1.45 | 76,002 | 12 |
| 10 | Spacer | 100 | Slickwater | 1,000 | 0 | 0 | 10 |
| 11 | 40/70 mesh | 100 | Slickwater | 1,310 | 0.75 | 41,250 | 13 |
| 12 | 40/70 mesh | 100 | Slickwater | 1,310 | 1 | 55,000 | 13 |
| 13 | 40/70 mesh | 100 | Slickwater | 1,071 | 1.25 | 56,250 | 11 |
| 14 | 40/70 mesh | 100 | Slickwater | 1,081 | 1.4 | 63,560 | 11 |
| 15 | Flush + 70 bbls | 100 | Slickwater | 553 | 0 | 0 | 6 |
| **Total with Flush** | | | | **15,668** | | **540,062** | **167** |

| | |
|---|---|
| Fluid Loading (bbl/cluster) | 2,611 |
| Proppant Loading (lb/cluster) | 90,010 |
| Fluid Loading (bbl/ft) | 87 |
| Proppant Loading (lb/ft) | 2,984 |
| Total Proppant per Stage (lbs) | 540,062 |
| Total Fluid (bbl/stage) | 15,668 |
| Clusters per Stage (-) | 6 |

| | |
|---|---|
| Total Proppant | 540 klbs |
| 100 mesh | 324 klbs |
| 40/70 | 216 klbs |

FIG. 8

LOOKING NORTH

DEPTH

ENHANCED GEOTHERMAL SYSTEM

PRIORITY CLAIM

This application claims the benefit of U.S. Provisional Application No. 63/527,289, titled, "COMMERCIAL-SCALE DEMONSTRATION OF A FIRST-OF-A-KIND ENHANCED GEOTHERMAL SYSTEM" filed on Jul. 17, 2023, which is hereby incorporated by reference in its entirety.

STATEMENT REGARDING FEDERALLY SPONSORED RESEARCH OR DEVELOPMENT

This invention was made with government support under award numbers DE-AR001153, DE-AR0001604, DE-EE0008486, and DE-EE0007080. The government has certain rights in this invention.

BACKGROUND

Geothermal energy is essential in a growing demand for the energy transition. Compared with other renewable electricity-generating technologies, geothermal power is constantly available, providing a sustainable baseload for customers. Conventional geothermal (hydrothermal) reservoirs have hot water in place and high permeability within the reservoir. Therefore, the energy can be harvested through the production of geothermal fluid. The produced hot fluid can be converted to steam to rotate a turbine to generate electricity or heat a working fluid with a lower boiling temperature, which evaporates and is used to rotate the turbine. The latter type of geothermal plant is called a closed-loop binary cycle power plant, as geothermal fluid is injected back into the reservoir. However, economically viable hydrothermal reservoirs are limited, and alternative design is required to develop more geothermal resources.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 8 illustrates a stimulation treatment pumping schedule for a typical stage at an injection well, in accordance with some examples.

DETAILED DESCRIPTION

Figure 1:
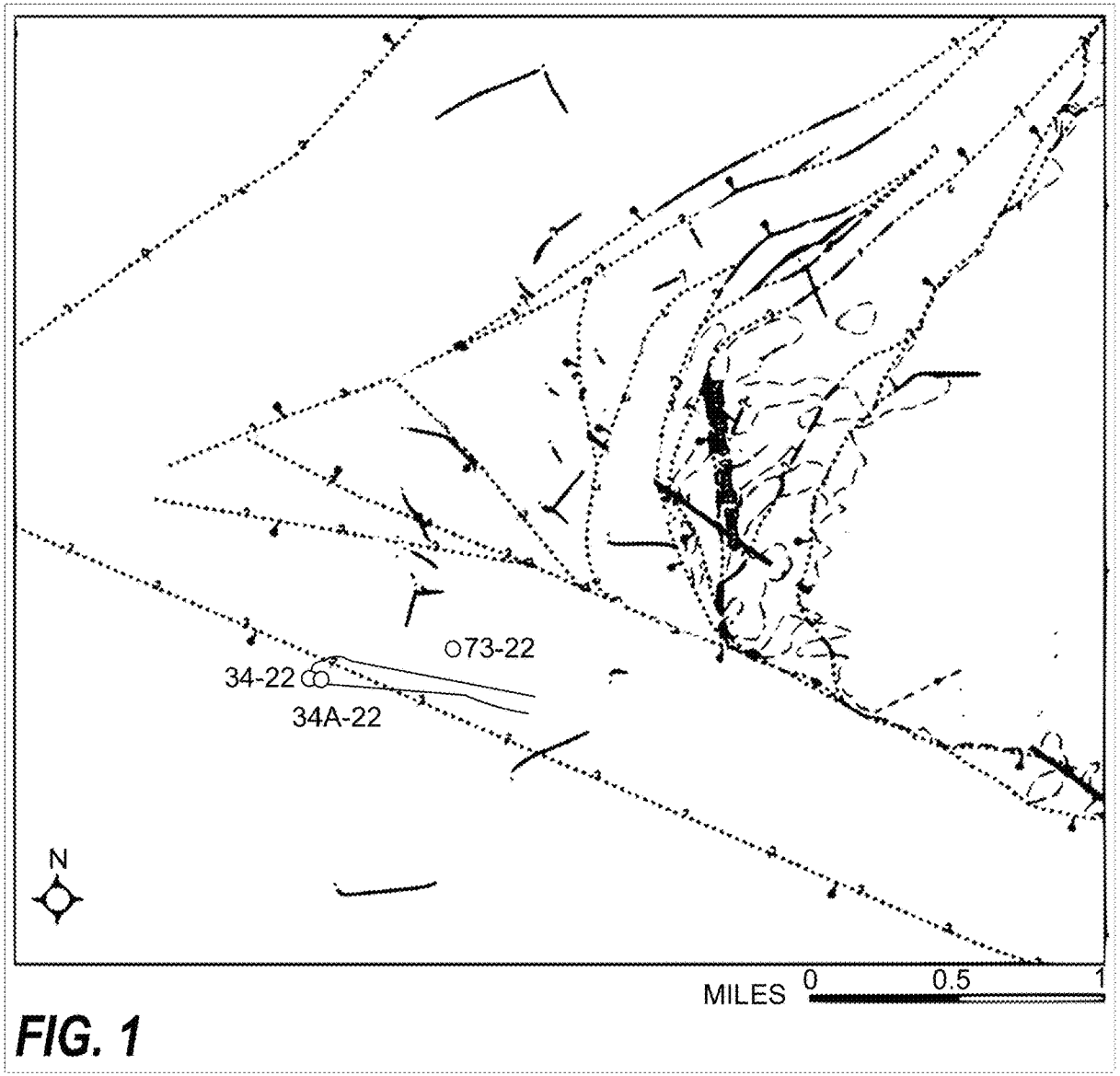
FIG. 1 illustrates a site map of a Blue Mountain project area, in accordance with some examples.

A commercial enhanced geothermal system (EGS) may be designed to deliver an uplift in high-temperature geothermal flow rates to increase power capacity at a geothermal power station facility. The EGS may include an EGS horizontal doublet well system, including an injection and production well pair within a high-temperature, hard rock geothermal formation. The lithology of a target reservoir may be characterized as a mixed metasedimentary and igneous formation, including phyllite, quartzite, diorite, and granodiorite, representative of the geology across the most prospective geothermal areas throughout the western US.

Firm, zero-carbon, dispatchable resources are useful for unlocking a fully decarbonized electricity sector. Geothermal power can play that role, as outlined in the Department of Energy's GeoVision Study and EarthShot Initiative, breakthroughs in enhanced geothermal system (EGS) technologies could unlock over 100 GW of clean, firm power in the United States. But in order to contribute a significant fraction of the energy mix, geothermal projects must be deployed with speed and scale that the industry has not yet achieved. Horizontal drilling has the potential to improve geothermal project economics significantly by providing greater access to the target reservoir volume, more consistent flow rates, more uniform flow distribution throughout the reservoir volume, and greater total heat transfer surface area. In addition, horizontal well designs offer many engineering design decisions that can be optimized to improve reservoir performance, including lateral length, offset well spacing, size of the stimulated reservoir volume, and fracture spacing along the wells. Horizontal well designs, stimulation treatment programs, and reservoir management strategies can be tailored for a given geologic resource which enables a broader range of geologies and locations to be developed than is possible with conventional geothermal development. In field-scale development programs, horizontal drilling can result in a significant reduction in surface land use because multiple wells can be drilled from a single pad location. Drilling many wells from the same pad can enable cascading cost savings opportunities, such as minimizing in-field rig moves, reducing drilling risk by drilling closely spaced vertical well sections, co-locating surface facilities infrastructure, and minimizing pipeline costs. The advantages of horizontal drilling described herein make it possible to replicate the dramatic learning curve cost-reductions that have been observed in the unconventional oil and gas sector over the last two decades. Drilling many wells in a condensed area allows for geologic, technical and experience learning curves to be applied as a development project progresses, improving project economics over time.

In an experimental example, lateral sections of wells were drilled with 9⅞" hole size, completed with 7" casing, extended approximately 3,250 ft horizontally, and reached a maximum measured temperature of 376F. A modern multi-stage, plug-and-perforate stimulation treatment design with proppant was used to enhance the permeability of both horizontal wells. A 37-day crossflow production test was performed, confirming that the EGS wells are connected hydraulically by a highly conductive fracture network. During production testing, the system achieved flow rates of up to 63 L/s, production temperatures of up to 336F and a peak power production of 3.5 MW electric power equivalent. Flow profile wireline logs were performed on the horizontal injection well during the crossflow test, validating that the stimulation treatment design resulted in flow allocation along the entire lateral. Production temperature increased continuously throughout the test, indicating that no significant thermal short-circuit pathways were created during stimulation operations. Based on a review of historic EGS projects, the experimental horizontal doublet well design is more productive than other identified EGS systems in terms of flow rate and electric power equivalent. Numerical reservoir simulation models calibrated with the field data from this project demonstrate that the power capacity may be increased up to 8 MW of electric power per production well, meeting or exceeding the performance criteria outlined in Advanced Scenario the National Renewable Energy Laboratory's 2023 Annual Technology Bulletin for geothermal energy. The experimental example involved designing and constructing a 3-well drilling program, including two horizontal wells that formed an injection and production doublet system and a deep vertical monitoring well.

FIG. 1 illustrates a site map of a Blue Mountain project area. The overall stratigraphic framework at Blue Mountain includes Miocene to present basin-fill deposits overlying Mesozoic phyllite. The phyllite is intruded by multiple phases of igneous dikes and sills interpreted to be Mesozoic and Tertiary in age. The range-front fault on the SW side of the Blue Mountain forms a prominent topographic break. On the NW side of Blue Mountain, silicified fault breccia is locally exposed in isolated outcrops surrounded by alluvium along the westernmost exposures of the surface trace of this fault. The westernmost exposure of this fault zone is silicified, and the silicification was interpreted to be relict. Kinematic data collected from fault surfaces along the western half of the range-front fault indicate dextral-oblique motion. Based on the map pattern of the faults and kinematic data, the Blue Mountain geothermal system is associated with a displacement transfer zone. In this structural model, the range-front along the SW side of the range is dextral-normal. This fault dies out into the basin west of the nose of the range and dextral shear is transferred to NE-striking normal faults that accommodate NW-SE extension in the form of pure dip-slip motion along the NW side of the Blue Mountain range. In this type of model, deep circulation would most likely be controlled by the N to NE-striking normal faults, near where they intersect the NW-striking dextral-normal fault system. South of the geothermal upflow and outflow zones of the primary hydrothermal system at Blue Mountain, there have been several wells drilled previously (86-22, 41-27, and 34-23) which exhibit relatively conductive temperature conditions and lack deep permeability or connectivity to the rest of the wellfield. This permeability boundary along the south side of the reservoir lies just south of Well 61-22 and has been interpreted to be associated with the down-dip projection of the southwest range-front fault. This recognized lack of deep permeability, reservoir connectivity, and elevated conductive temperatures radiating from the active system to the north makes the southern field relatively compartmentalized, and therefore a useful testbed for a horizontal well program. A site map of the project area highlighting the location of the horizontal wells is shown in FIG. 1. The horizontal well EGS doublet system includes an Injection Well 34A-22 and a Production Well 34-22, which are located in the southern margin of the field. A Monitoring Well 73-22, located at approximately the mid-lateral and to the north of the horizontal doublet system, includes a permanent fiber optic monitoring system and a downhole gauge to measure reservoir pressure and temperature.

Figure 2:
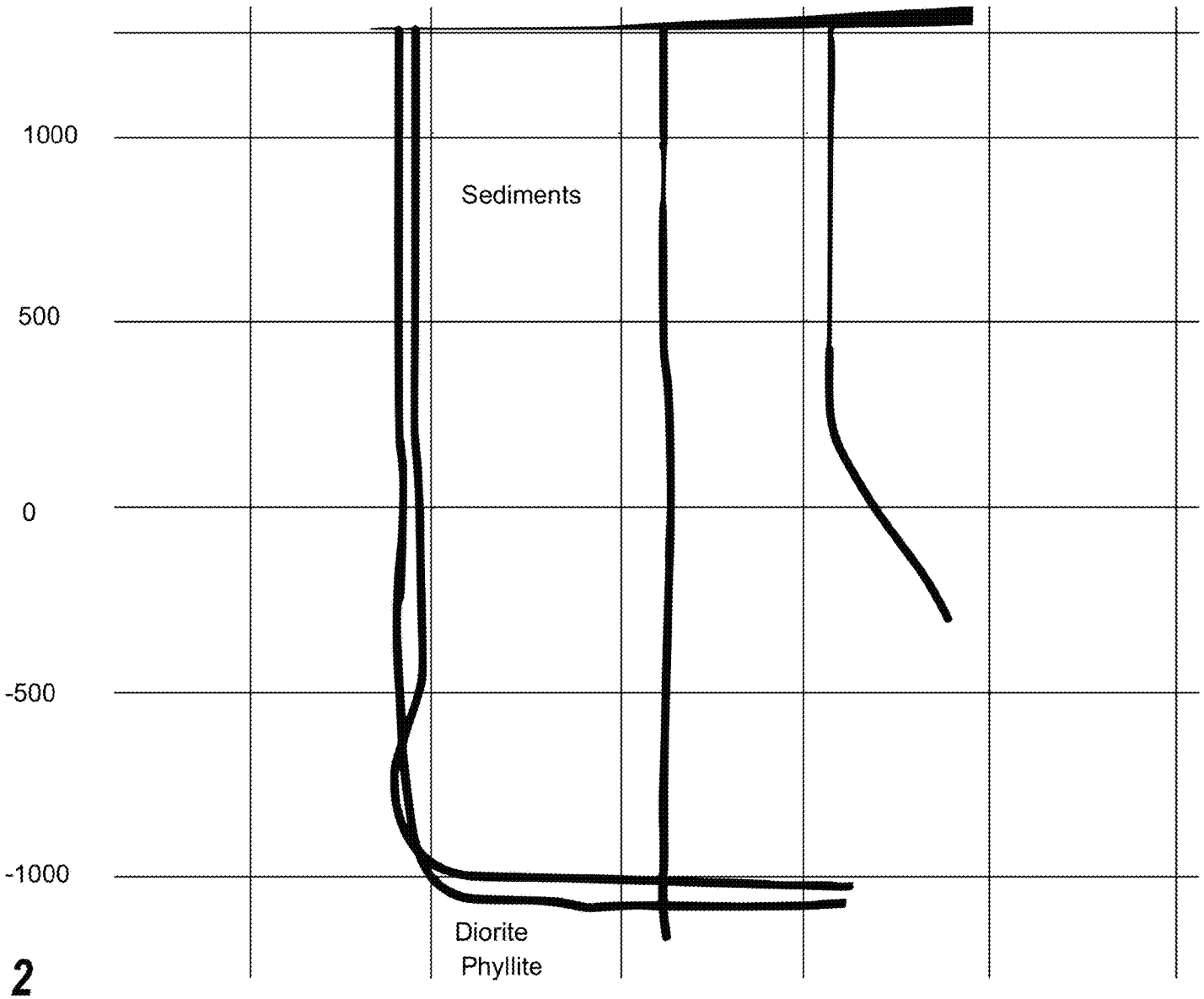
FIG. 2 illustrates a cross-section of a horizontal doublet enhanced geothermal system (EGS) system and deep vertical monitoring well, in accordance with some examples.
Figure 3A:
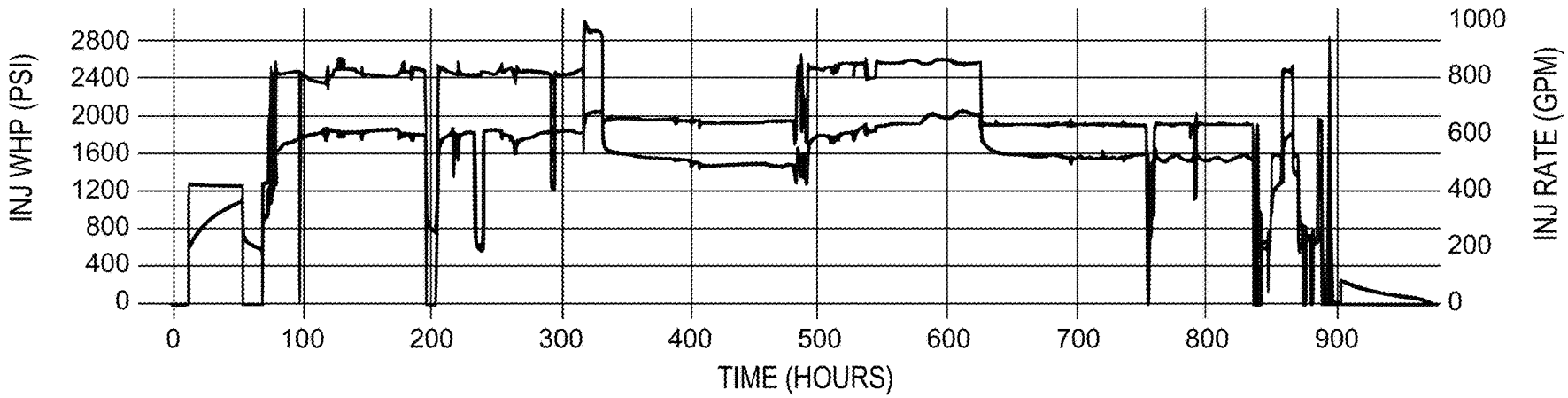
FIGS. 3A-3B and 4A-4B illustrate flow rate and wellhead pressure recordings during a circulation test for an injection well and a production well, in accordance with some examples.
Figure 3B:
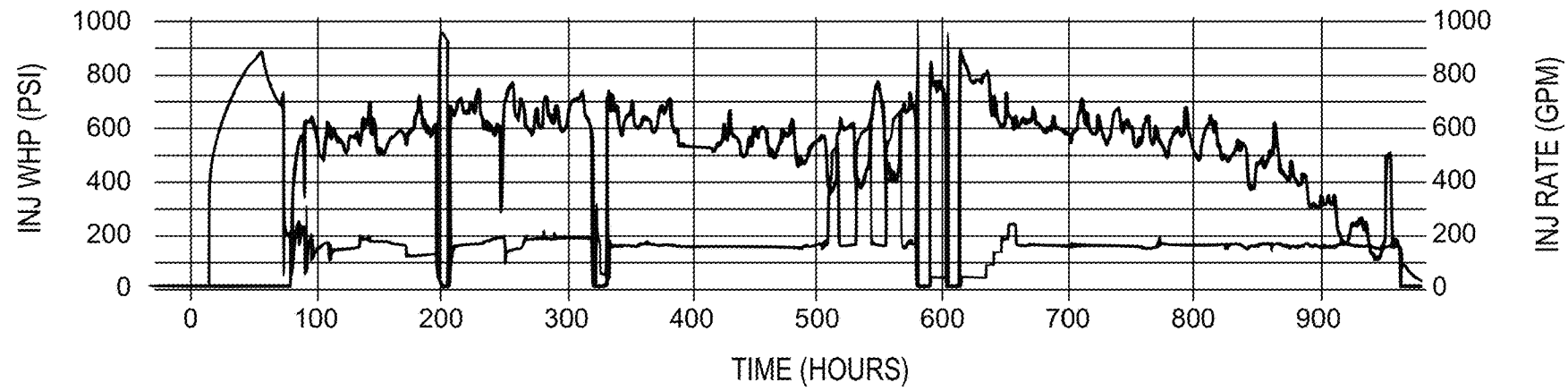
Figure 4A:
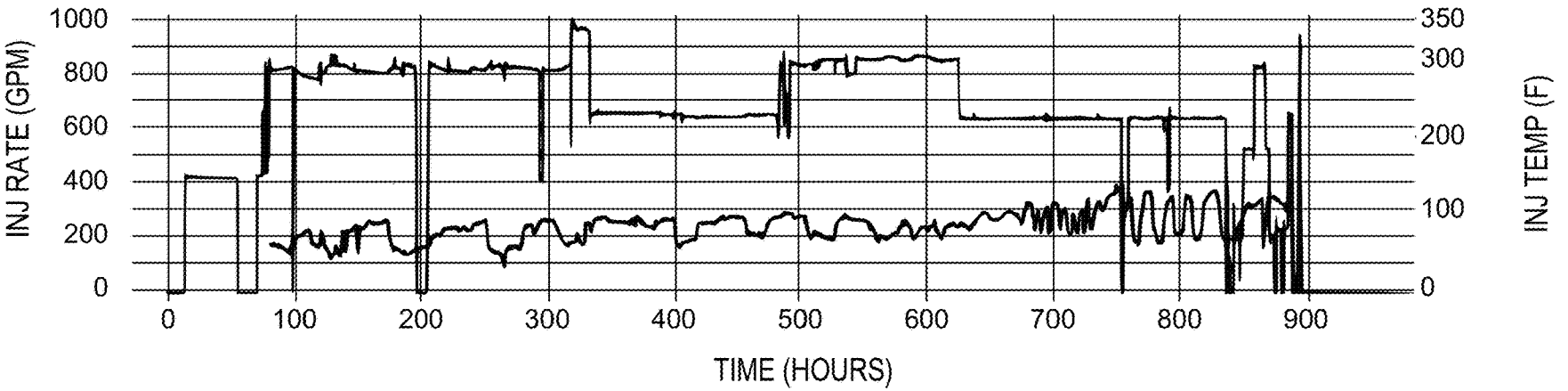
Figure 4B:
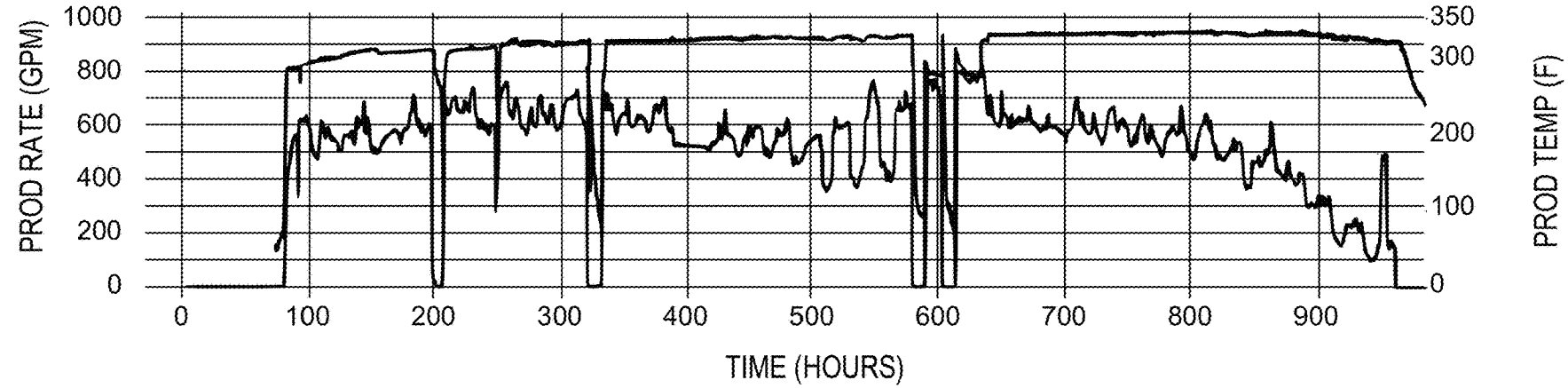

FIG. 2 illustrates a cross-section of an example horizontal doublet EGS system and deep vertical monitoring well, in accordance with some examples. A horizontal doublet well system was drilled in the southern margin of the Blue Mountain geothermal field (Injection Well 34A-22 and Production Well 34-22), and a deep vertical monitoring well was also drilled for the purposes of reservoir characterization and stimulation treatment monitoring (Monitoring Well 73-22). The horizontal well designs were driven by the following factors: a) the requirement of a 7" production casing string to enable commercial flow rates, b) the requirement of permanent fiber optic cable installation cemented behind the production casing for improved reservoir and wellbore diagnostics, c) a conservative casing program that would be robust against known and unknown geologic hazards in this first of a kind project, d) the local state of stress, and e) the three-dimensional temperature distribution in the reservoir. The laterals of the two horizontal wells were landed at a true vertical depth of approximately 7,700 ft and the productive lateral sections each extended roughly 3,250 ft. For this example system, the well construction program was designed conservatively to mitigate known and unknown geologic hazards, including the potential for zones that could cause major fluid losses while drilling. The horizontal wells were designed with four primary casing strings, including a surface casing string set at approximately 800 ft, an intermediate casing string set in the basement formation at approximately 3500 ft, a second intermediate casing string set at the end of the curve at approximately 8000 ft, and the production casing string that ran from surface to the total depth of the well. The production casing was selected as 7", 35 ppf, P-110 casing. Running the production casing string from surface to total depth allowed for permanent fiber optic sensing cables to be installed along both Injection Well 34A-22 and Production Well 34-22. A cross-section of the horizontal wells and monitoring well is shown in FIG. 2.

Upon successfully drilling, completing, and stimulating the horizontal doublet well system, a production test may be provided to measure the power capacity of the system as well as to evaluate key performance characteristics of the EGS reservoir. The well test may include circulating geothermal fluid through the doublet system by pumping fluid down Injection Well 34A-22, through the fractured reservoir system, and up Production Well 34-22. Injection pumps located on the well pad and connected to the well-head of Injection Well 34A-22 provided the pressure to drive fluid through the system. The produced fluid may be pumped through a series of holding tanks to provide the residence time for the water to cool sufficiently and was ultimately recirculated for injection. The injectate may include a mixture of the produced fluid and saline brine sourced from a nearby groundwater well. Both wells may be instrumented to measure wellhead pressure, flow rate, and fluid temperature. Fluid sampling ports may be located at several points throughout the system. A test may include phases, such as: a constant-rate injection period with the production well shut-in, followed by a 12-hour pressure falloff period, establishment of crossflow conditions, a tracer test, a first steady-state performance test, a load-following dispatchability test, a wellbore deliverability curve and a second steady-state performance test, and wireline flow profile logging and final shut down, or the like. Throughout the well test, a valve located just downstream of the Production Well 34-22 wellhead may be controlled to maintain back-pressure on the system. The wellhead pressure at Production Well 34-22 may be maintained at a pressure between approximately 100 psi to 200 psi, which is equivalent to the wellhead pressure anticipated during commercial operations once the system is integrated with the adjacent wellfield and power plant.

In an example, electric power of a system can be estimated directly from field data using measured flowing thermal power and assuming a thermal-to-electric power conversion efficiency for a relevant power cycle. In an example, air-cooled organic Rankine cycle (ORC) technology may be used. The equivalent gross electric power production may be calculated according to Equation 1:

$$P_{gross} = \eta_u B \qquad \text{Equation 1}$$

In Equation 1, Pgross is gross electric power production, hu is the utilization efficiency of the power plant, and B is the exergy of the produced geothermal fluid. The exergy can be calculated based on the specific enthalpy h and specific entropy s of the geothermal fluid at production (prod) and ambient (0) conditions according to Equation 2:

$$B = m_{prod}[h_{prod} - h_0 - T_0(S_{prod} - s_0)] \qquad \text{Equation 2}$$

In Equation 2, m total is the mass flow rate of the produced fluid at $T_0$ is the ambient temperature. A technique may be used to evaluate the power plant utilization efficiency as a function of the produced fluid temperature for a variety of generator technologies. The electric power required to run the injection pumps can be calculated according to Equation 3:

$$P_{pump} = \frac{q_{inj}P_{inj}}{\eta_{pump}} \qquad \text{Equation 3}$$

In Equation 3, $q_{inj}$ is the volumetric injection rate, $P_{inj}$ is the injection wellhead pressure, and $\eta_{pump}$ is the pump efficiency, which can be taken directly from the manufacturer's pump curve. For a test, the injection rate and pressure conditions may be operated over a sufficiently narrow range to justify assuming a pump efficiency of $\eta_{pump}$=0.80. The pumping power acts as a parasitic load on the system, therefore the net electric power generated by the system is calculated according to Equation 4:

$$P_{net} = P_{gross} - P_{pump} \qquad \text{Equation 4}$$

Flow rate, pressure, and temperature conditions at Injection Well 34A-22 and Production Well 34-22 were measured continuously throughout a test. Throughout the majority of the test, the produced fluid was maintained under single-phase (i.e., liquid) flowing conditions, therefore no downhole measurements may be needed to evaluate the mass flow rate or enthalpy of the produced fluid.

Figure 5:
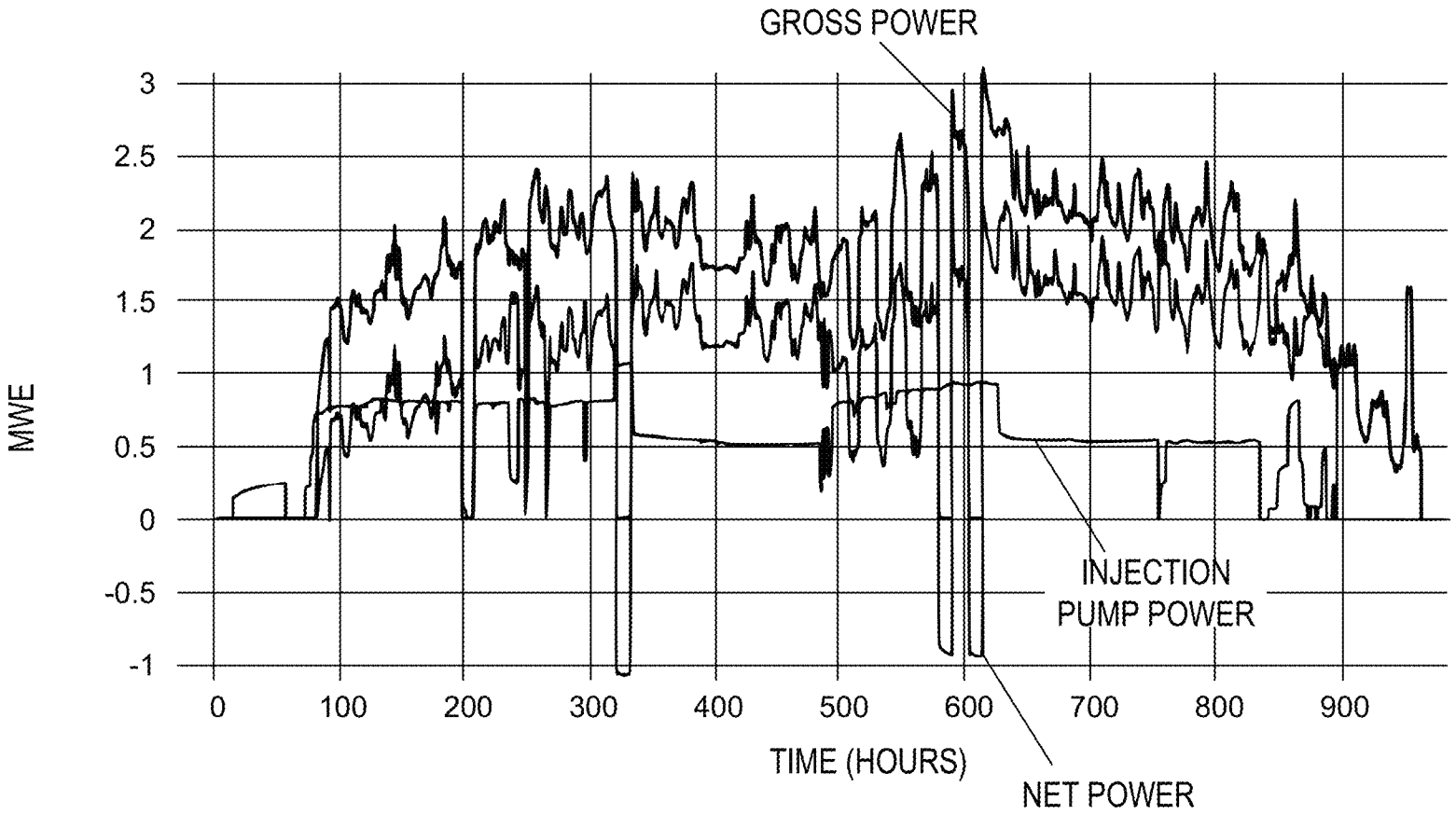
FIG. 5 illustrates an electric power production (e.g., gross and net) and injection pump power consumption during a circulation test, in accordance with some examples.

FIGS. 3A-3B and 4A-4B illustrate flow rate and wellhead pressure recordings during a circulation test for an Injection Well 34A-22 (3A and 4A) and a Production Well 34-22 (3B and 4B). FIG. 5 illustrates an electric power production (e.g., gross and net) and injection pump power consumption during a circulation test.

In FIGS. 3A-3B, 4A-4B, and 5 show wellhead pressure, temperature, flow rate, and associated power profiles throughout the full duration of a crossflow test. The rate and pressure responses between Injection Well 34A-22 and Production Well 34-22 are strongly correlated, with changes in one well causing a rapid response in the offset well typically on the order of minutes to tens of minutes. The rapid response times between the wells indicates that the stimulation treatment resulted in a strong hydraulic connection between the wells. The system may be capable of supporting commercial levels of production. Injection rates throughout most of the test ranged from 650 gpm to 850 gpm, with a maximum injection rate of 1003 gpm. Injection pressures were highly rate-dependent and ranged from 1000 psi to 2000 psi throughout the test. Injection pressures were maintained below the fracturing pressure of approximately 2300 psi. Pressures tend to remain relatively steady while injecting at a constant rate and while actively producing. During periods where the production well was shut-in and injection was occurring, injection pressures tended to increase. Injection fluid temperatures ranged from 75 to 125F, with the fluctuations being driven by changes in the relative mix of recirculated produced water and makeup water. Production rates typically ranged from 550 gpm to 750 gpm with a maximum production rate of 970 gpm. Production rates were typically 10-20% lower than the injection rates, which can be attributed to leakoff of fluid in the subsurface. The production fluid temperature increased quickly early in the test as the near-wellbore region heated up, and then slowly continued increasing throughout the test to a maximum temperature of 336F. Steadily increasing production fluid temperature indicated that the system had no significant fast flowing pathways that could potentially cause premature thermal breakthrough. An aspect of the field demonstration indicates that the EGS system may be operated without the use of artificial lift (e.g., downhole line shaft pump or electrical submersible pump) in the production well. In this circulation test, the pressure to drive flow through the system was provided entirely by a set of horizontal centrifugal pumps connected to the Injection Well 34A-22 wellhead. The wellhead pressure at Production Well 34-22 was controlled by a gate valve located immediately downstream of the wellhead master valve. The producer wellhead was closed for the first two days of the test while injection occurred at a constant rate, which allowed the reservoir to pressurize to at least 900 psi above the initial reservoir pressure. At this point, the producer wellhead was opened and the main production phase began. Production flow was sustained entirely by the artificial overpressure conditions in the reservoir. This behavior continued throughout the duration of the crossflow test, which confirms that the system behaved as a relatively confined system and that artificial lift is not required for commercial production. A supercritical ORC power cycle and ambient temperature of T0=8C may be used with Equation 1. A gross power output occurred between 2 to 3.5 MW throughout the test. The pumping power requirements ranged from about 500 kW to 1000 kW depending on the injection rate and pressure.

In Table 1 below, a comparison of the flow rate from injection, production, or circulation tests following a stimulation treatment phase at several of well characterized EGS projects against the peak flow rates measured in Injection Well 34A-22 and Production Well 34-22 are illustrated. These results demonstrate that the horizontal well design and multistage stimulation treatments with proppant has resulted in the most productive EGS system to-date.

| Project Name | Year | Flow Rate (L/s) |
|---|---|---|
| Le Mayet | 1978 | 5 |
| Hijiori | 1988 | 17 |
| Fenton Hill | 1992 | 7 |
| Gros Schonebeck | 2003 | 16 |
| Paralana | 2005 | 6 |
| Landau | 2007 | 25 |
| Northwest Geysers | 2011 | 7 |
| Cooper Basin | 2012 | 19 |
| Desert Peak | 2013 | 19 |
| Bradys | 2013 | 6 |
| Newberry | 2014 | — |
| Soultz-sou-Forets | 2017 | 30 |
| Fervo 34-22 | 2023 | 61 |
| Fervo 34A-22 | 2023 | 63 |

Table 1 is a comparison of peak flow rate measured during long-term flow rate tests following the stimulation treatment phase for several notable EGS projects throughout the world.

Figure 6:
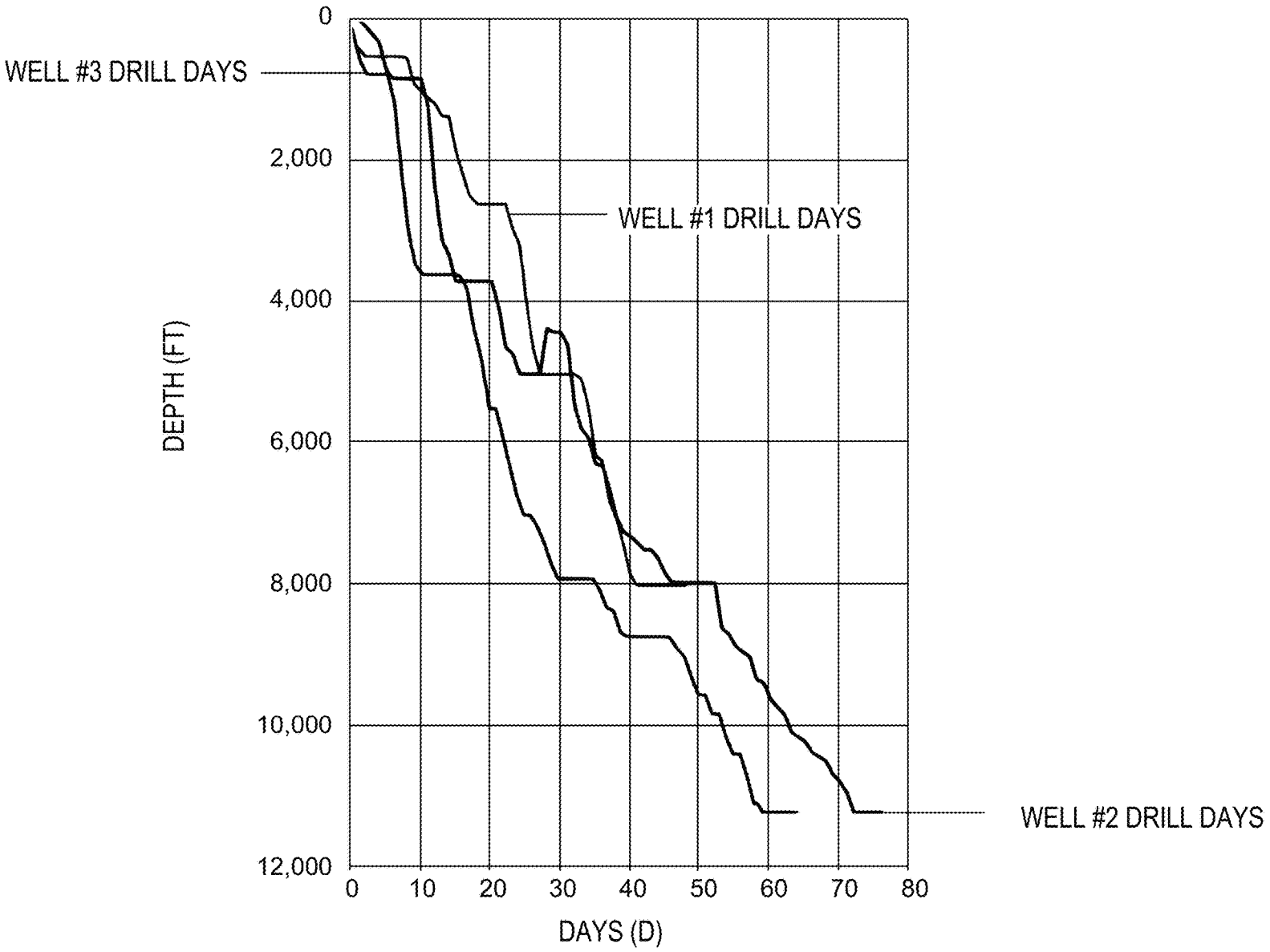
FIG. 6 illustrates drilling performance results for a three-well drilling program, in accordance with some examples.

FIG. 6 illustrates drilling performance results for a three-well drilling program, in accordance with some examples. A thirteen day reduction in drilling days was achieved between the first and second horizontal wells. The drilling sequence in the project was to first drill the vertical Monitoring Well 73-22, then drill Injection Well 34A-22, followed by drilling Production Well 34-22. Production Well 34-22 was drilled after the reservoir stimulation treatment was performed in Injection Well 34A-22, and the well path was planned to intersect the stimulated reservoir volume. The days-versus depth-curves for the three wells are shown in FIG. 6. Monitoring Well 73-22 was drilled to a total depth of 8,009 ft MD in 41 days. Injection Well 34A-22 was drilled to a total depth of 11,220 ft MD in 72 days. Production Well 34-22 was drilled to a total depth of 11,211 ft MD in 59 days. Significant improvements in drilling performance occurred throughout the program, resulting in an 18% reduction in total drilling days between the first and second horizontal wells. Static temperature profiles were measured with the distributed temperature sensing (DTS) fiber optic cables and calibrated against the downhole temperature gauge in 73-22 as well as wireline temperature surveys.

Figure 7:
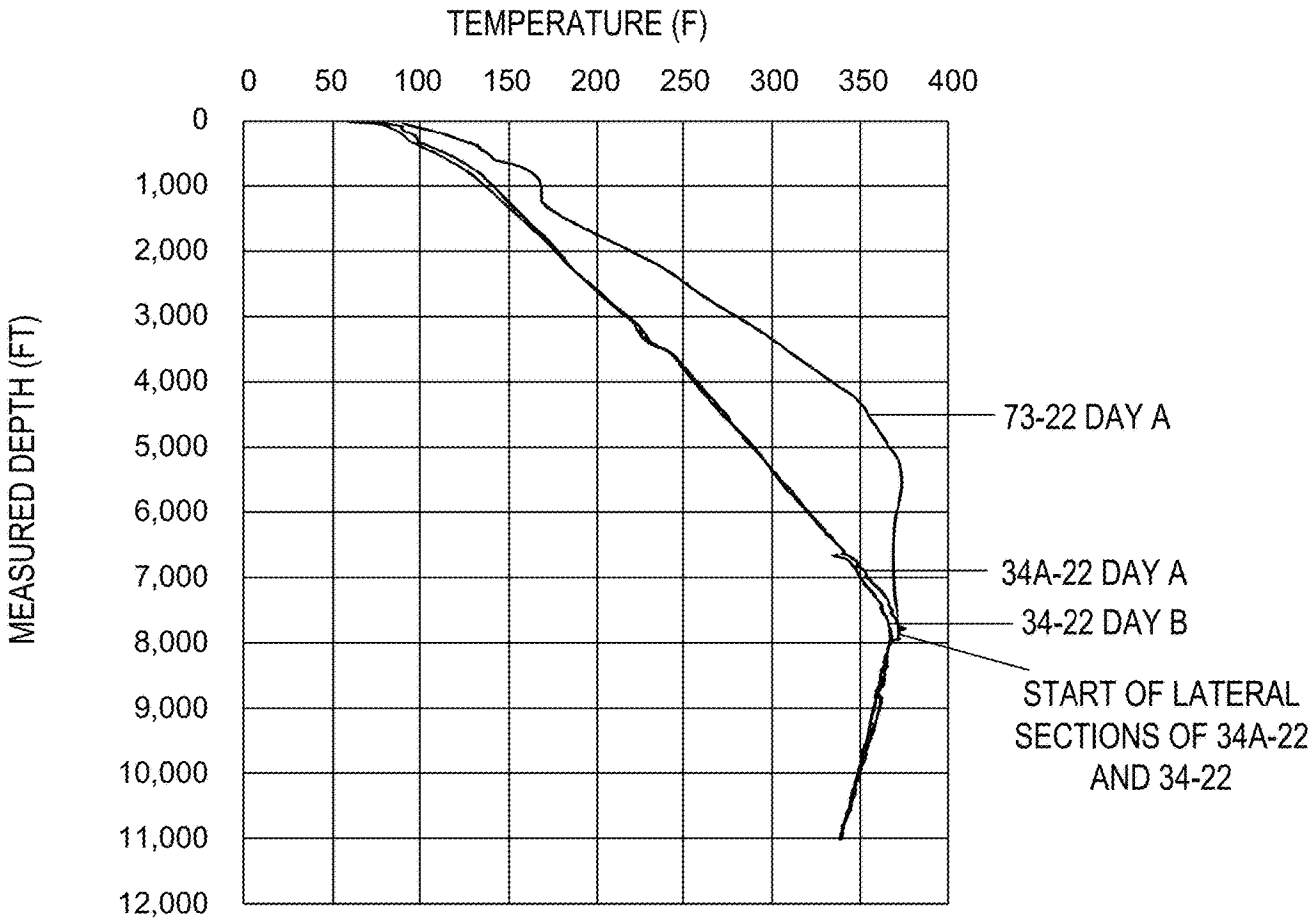
FIG. 7 illustrates equilibrated temperature profiles for wells, in accordance with some examples.

FIG. 7 illustrates equilibrated temperature profiles for Wells 73-22, 34A-22, and 34-22. The maximum recorded temperature on the three wells was 376F. Although the lateral sections on 34A-22 and 34-22 are at a constant true vertical depth, the temperature tends to decline slightly towards the toe due to the temperature distribution in the project area. The equilibrated temperature profiles for the three wells are shown in FIG. 7. The maximum recorded downhole temperature was 376F (191C). The performance in the three well drilling system achieved an 18% well-over-well reduction in drilling days, which validates that no barriers exist to drilling horizontal wells today and demonstrates a clear cost reduction trajectory.

FIG. 8 illustrates a stimulation treatment pumping schedule for a typical stage at an injection well, in accordance with some examples. The stimulation treatment design includes a plug-and-perforate style treatment with a low-concentration friction reducer slickwater fluid system. A combination of 40/70 mesh and 100 mesh silica proppant may be used. An injection well (e.g., 34A-22) may be completed with a total of 16 stages. A production well (e.g., 34-22) may be completed with a total of 20 stages. The two horizontal wells may be completed with a plug-and-perforate (plug-and-perf) stimulation treatment design. In the plug-and-perf design, the horizontal section of a well is stimulated in stages starting at the toe of the well and sequentially moving uphole toward the heel of the well. The stage length is typically on the order of 100 ft to 300 ft, and within each stage several discrete zones along the wellbore are perforated. The stimulation involves pumping a slurry of fluid and proppant down the wellbore and through the perforations in order to initiate fractures in the rock. The proppant acts to hold the fractures open in increase their conductivity. The plug-and-perf design relies on a technique called limited entry, taking advantage of the pressure drop that occurs as fluid flow through perforations in the wellbore which then serves to passively redistribute the flow more uniformly across multiple perforation clusters located along a subsection of the horizontal well. Each stage may have roughly a same length (e.g., approximately 150 ft). Stages may be planned with a similar perforation cluster design, such as with 6 clusters per stage and 6 perforation shots per cluster, or 9 clusters per stage and variable shots per cluster. The perforation clusters may be designed with a limited entry style design, for example targeting approximately 1,500 psi of perforation friction. The treatment design may include pumping a total of approximately 16,000 bbl of fluid and 540,000 lbs of proppant in each stage. A target injection rate may include 100 bpm. Stimulation fluid may include a slickwater treatment design with a low-concentration friction reducer additive. A proppant may include a mixture of 100 mesh and 40/70 mesh silica sand, pumped at concentrations ranging from 0.25 to 1.5 ppg. Each stage may last approximately three hours. A pumping schedule for a typical stage is shown in FIG. 8.

Figure 9A:
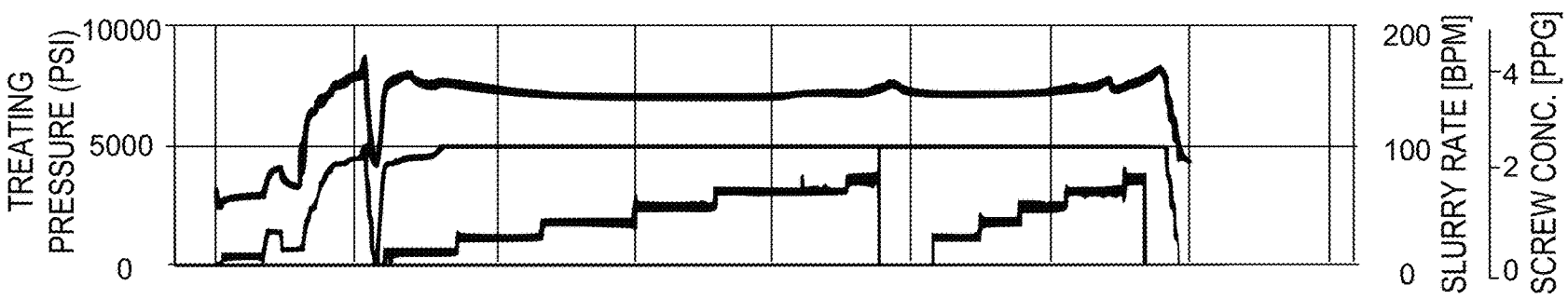
FIGS. 9A-9C and 10A-10B illustrate a treatment plot, in accordance with some examples.
Figure 9B:
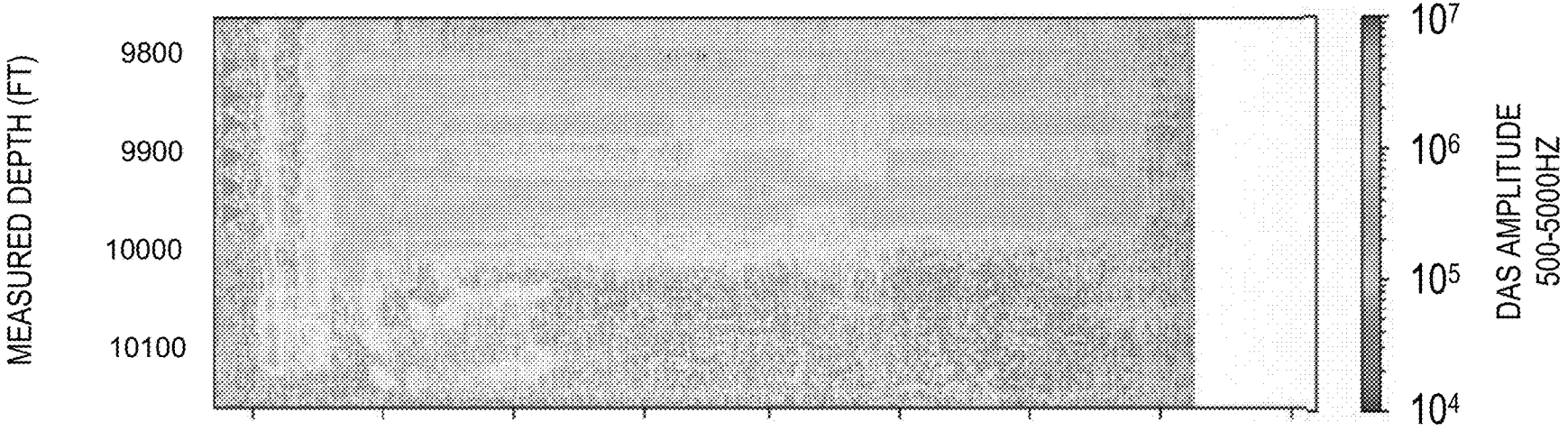
Figure 9C:
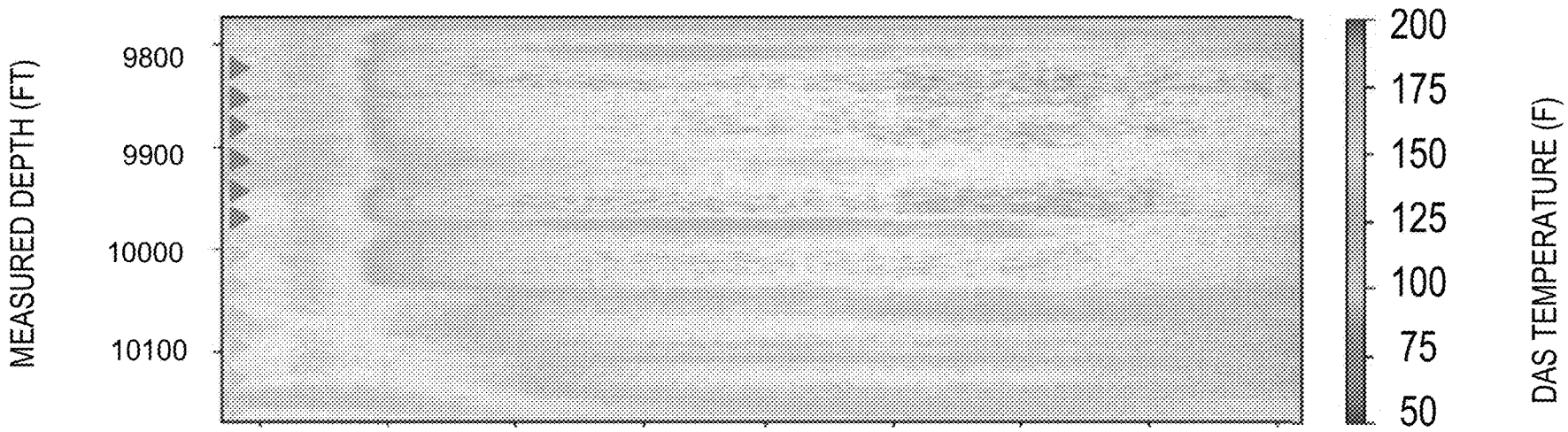
Figure 10A:
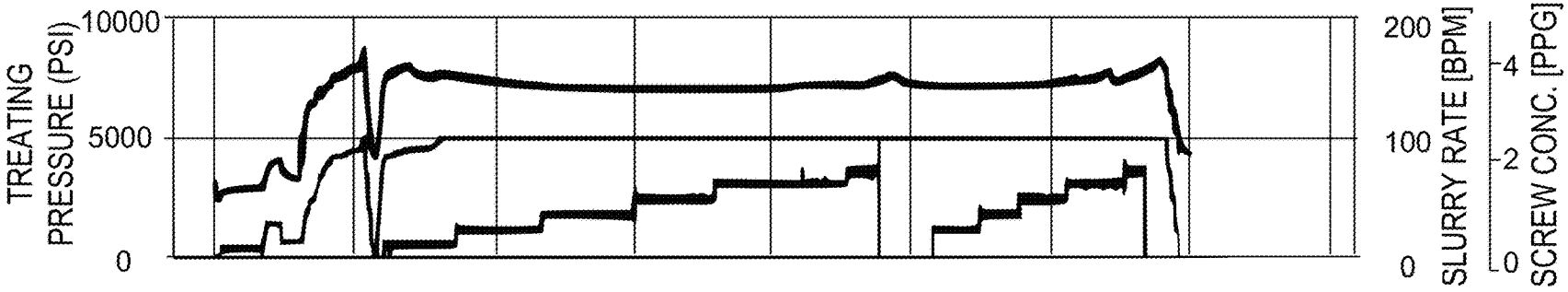
Figure 10B:
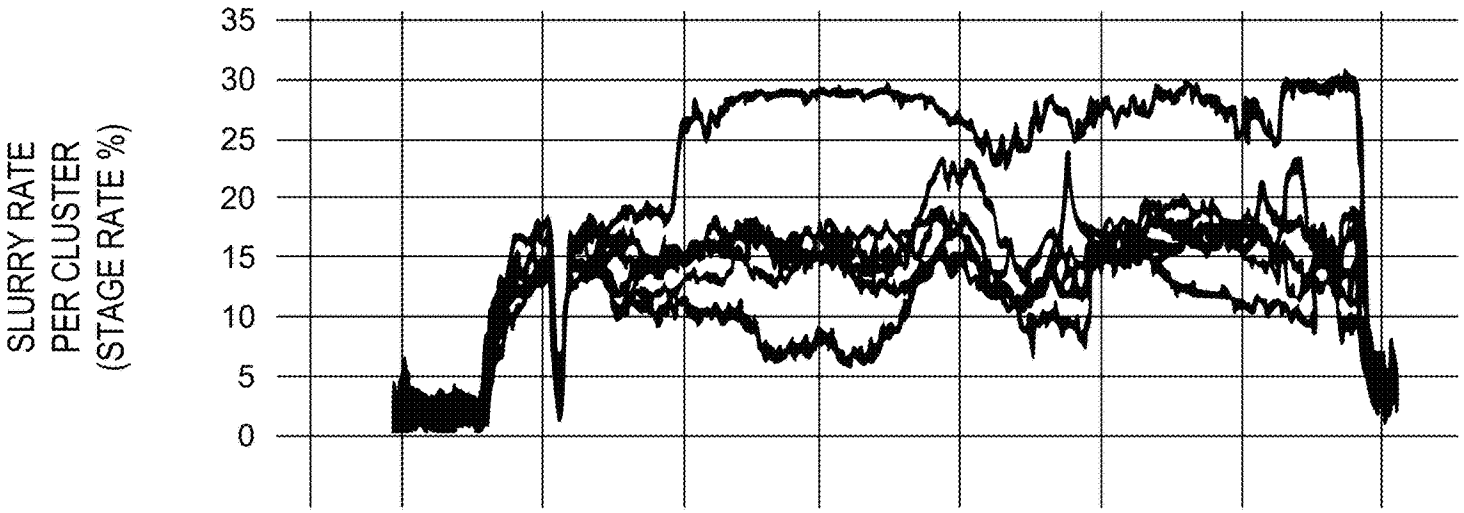
Figure 11:
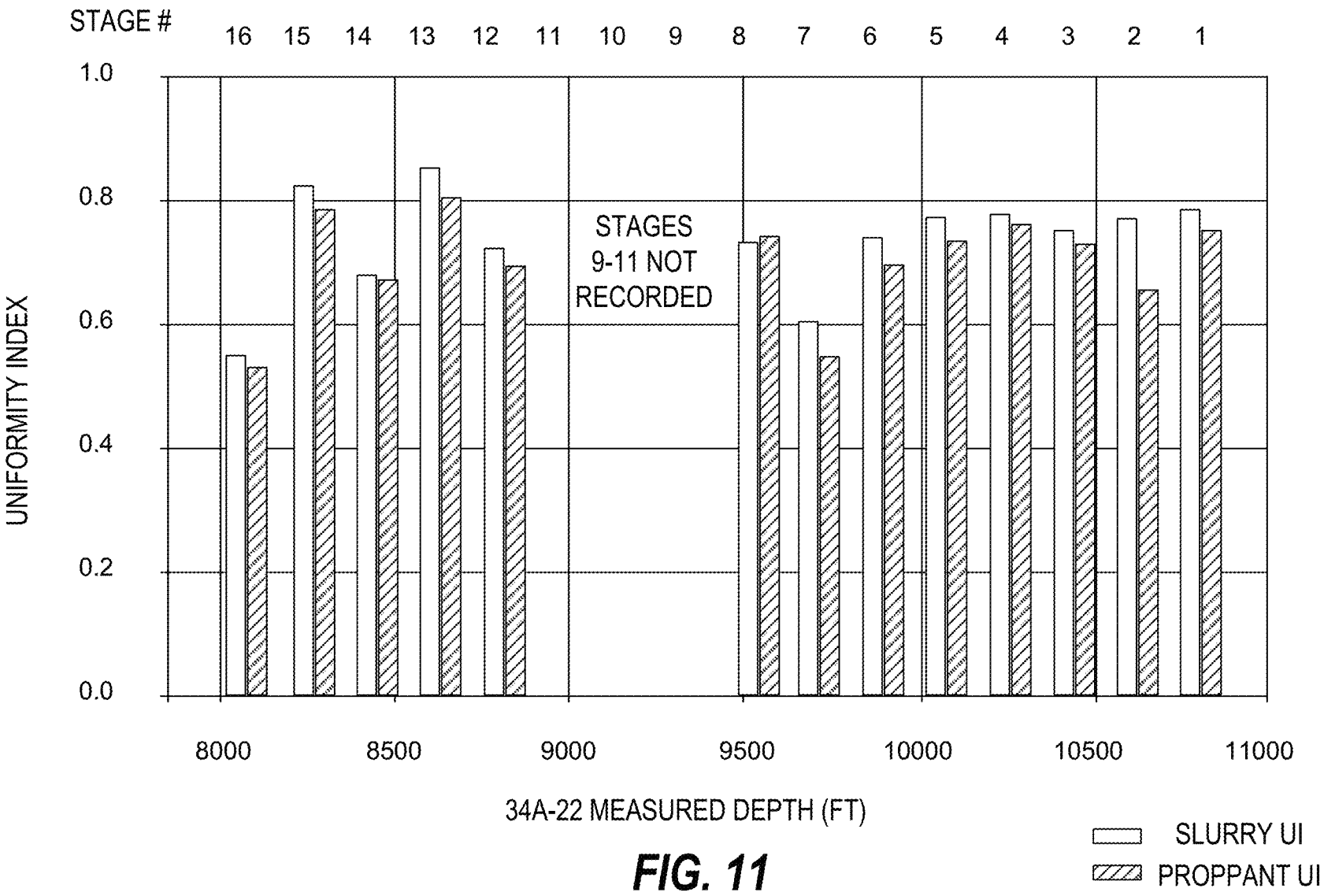
FIG. 11 illustrates a flow uniformity index for fluid and slurry based on correlations with DAS data for several stages, in accordance with some examples.

FIGS. 9A-9C and 10A-10B illustrate a treatment plot, in accordance with some examples. The surface injection pressure, injection rate, and proppant concentration is shown in FIG. 9A. FIG. 9B illustrates a DAS waterfall plot showing acoustic signal and location of the perforation clusters from the active stage and previous stage. FIG. 9C illustrates a DTS waterfall plot showing the temperature variations along the well throughout the duration of an active stage. FIG. 10A shows a treatment plot for a typical stage. FIG. 10B illustrates a DAS-derived slurry rate allocation for each of the six perforation clusters in the treatment stage. The target total slurry injection rate during that stage was 100 bpm, corresponding to a target of 16.7 bpm per cluster. The cluster-level flow allocation shows that 4 out of 6 clusters received the target flow rate and the remainder of the flow as spread across the other two clusters. FIG. 11 illustrates a flow uniformity index for fluid and slurry based on correlations with DAS data for several stages, in accordance with some examples. FIG. 11 includes data from Well 34A-22. The flow uniformity indices range from 56% to 81% across all stages monitored, with the majority of stages exhibiting slurry uniformity indices greater than 70%.

The treatment plot for a typical stage (e.g., stage 6 on Injection Well 34A-22) is shown in FIGS. 9A-9C. The in-well fiber optics data provides information related to downhole behavior in real-time before, during, and after each stage. This fiber optic data includes useful information on the stimulation treatment effectiveness and the downhole conditions for various tools. The in-well DAS data may be used to verify whether fracture initiation occurred at each perforation cluster as well as the flow allocation across all clusters in the stage. In this example, six perforation clusters broke down and received flow for the full duration of the stage. Taking the DAS amplitude signal as a proxy for flow rate at each perforation cluster, clusters 2, 3, and 5 as shown were the most active (see e.g., FIGS. 10A-10B). All clusters accepted fluid and the overall flow uniformity index was calculated as 73%. During the stimulation treatment, the DTS data can be used to determine stage isolation and to determine if any leakage is occurring into the previous stage, such as around the plug or behind the casing. In this example, some cooling was observed downstream of the plug in the first half of the stage, but toward the middle of the stage a clear warmback signal occurs. The relatively small amount of cooling early in the stage may be caused by near-well fracture communication as fracture initiation occurred, as opposed to a leaky plug. The relatively low levels of acoustic activity downstream of the bridge plug indicate that good stage isolation was achieved. In-well fiber optic sensing data was recorded for 13 out of the 16 stages in Injection Well 34A-22. Based on an analysis of fiber data for all stages, fracture breakdown and initiation occurred at 100% of the perforation clusters, regardless of the lithology that the perforation clusters were located in. The uniformity index ranged from 56% to 81% across all stages (see e.g., FIG. 11). The stages with nine clusters showed relatively good flow distribution, verifying that extreme limited entry completions are likely a viable path towards meaningful cost reductions in future drilling campaigns.

Figure 12B:
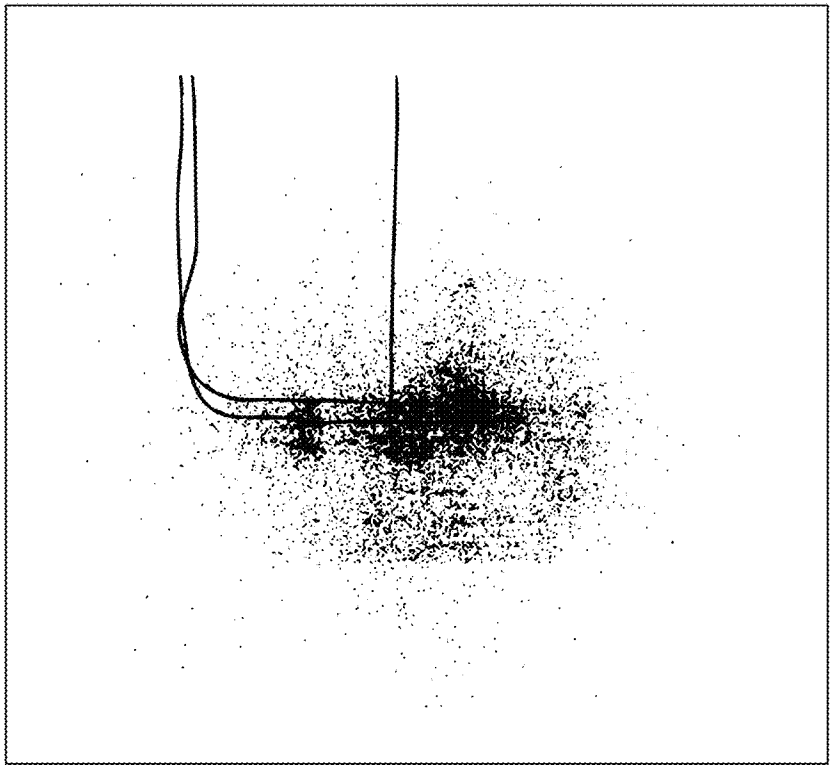
FIG. 12A illustrates a plan view and FIG. 12B illustrates a cross-section view of a distribution of microseismic events recorded during stimulation treatments of an example injection well and an example production well, in accordance with some examples.
Figure 12A:
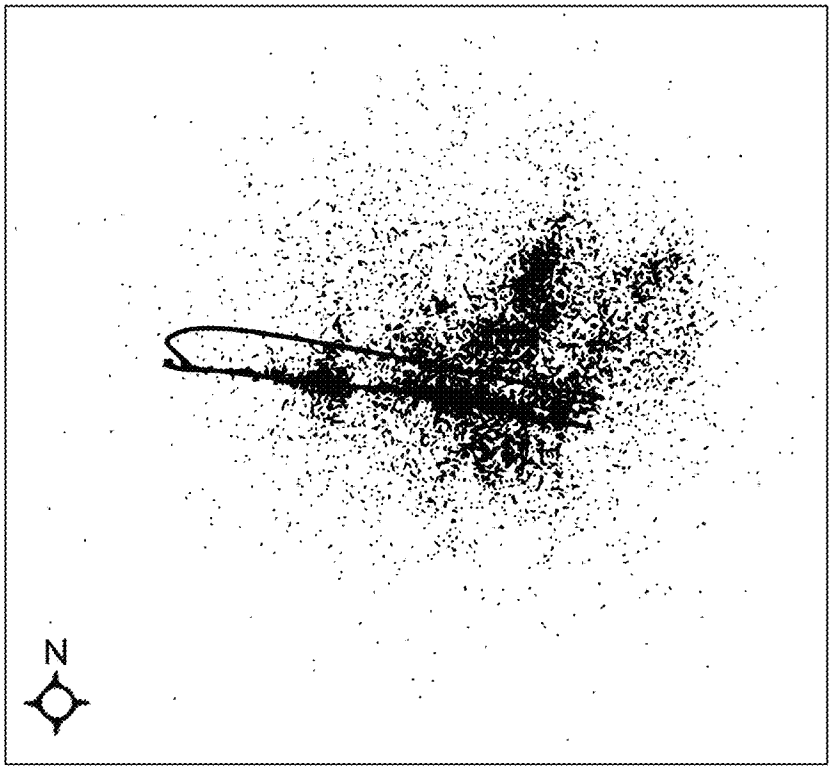

FIG. 12A illustrates a plan view and FIG. 12B illustrates a cross-section view of a distribution of microseismic events recorded during stimulation treatments of an example injection well and an example production well, in accordance with some examples. For example, the injection well may be Injection Well 34A-22 and the production well may be Production Well 34-22. These events represent the locations of the highest quality events detected on the multiwell DAS fiber optic sensing array.

Figure 13B:
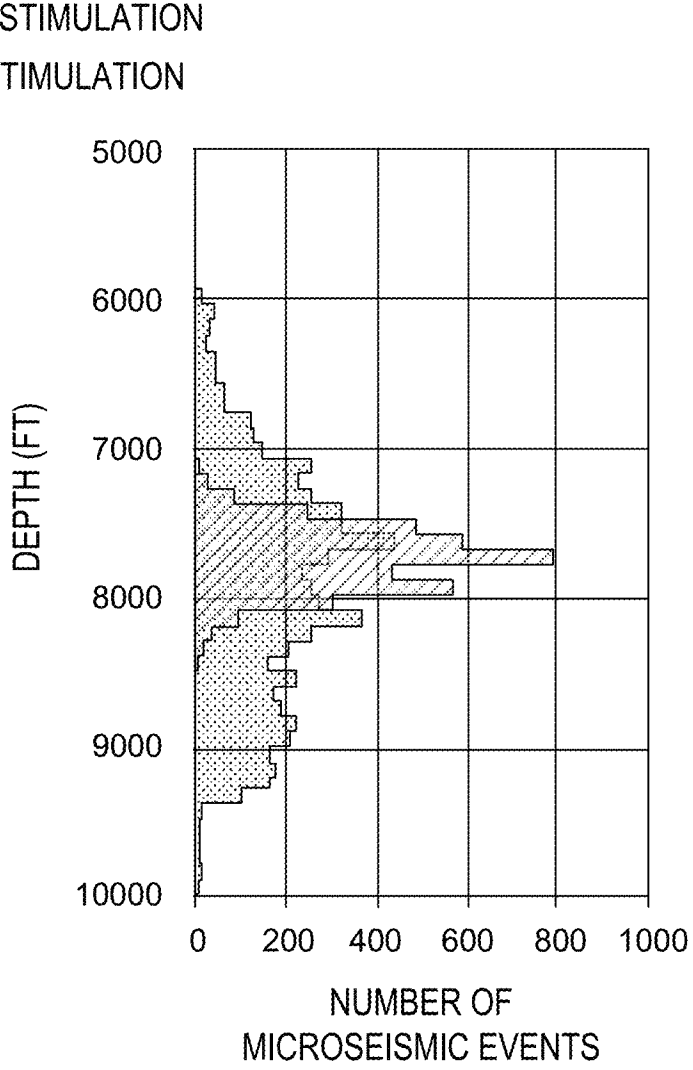
FIGS. 13A-13B illustrate microseismic-derived stimulated reservoir volume geometry, in accordance with some examples.
Figure 13A:
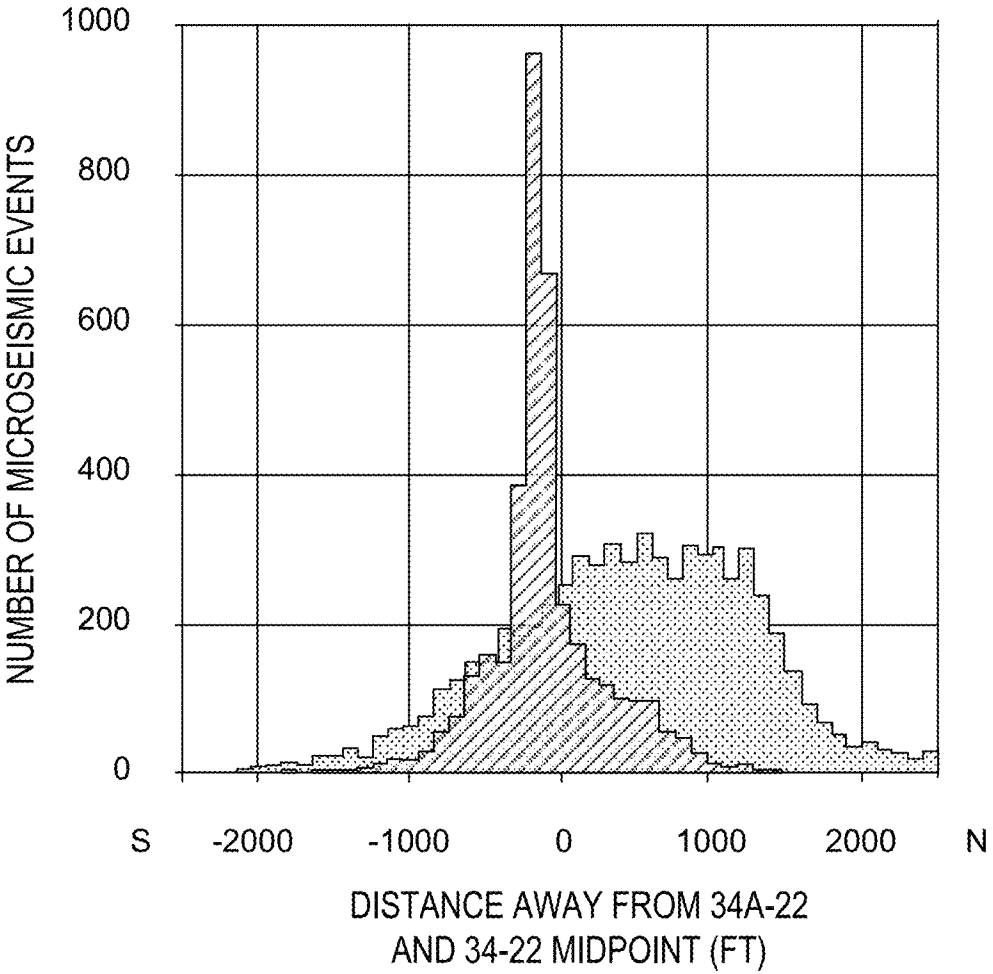

FIGS. 13A-13B illustrate microseismic-derived stimulated reservoir volume geometry, in accordance with some examples. Histograms in FIGS. 13A-13B indicate microseismic events distributions away from the wells (13A) and with depth (13B) for both 34A-22 and 34-22 stimulation treatments. The reference locations of the wells are indicated with dash-dotted lines. The solid lines represent the interpreted extent of the induced fractures.

An example purpose of the multistage, multicluster stimulation treatment program is to enhance the permeability of the reservoir, create extensive fracture surface area the enable sustainable heat transfer rates, and distribute flow uniformly throughout the reservoir to improve thermal recovery factors. The geometry of the stimulated reservoir volume (SRV) is a useful metric for characterizing reservoir performance. A variety of independent datasets may be used to constrain the SRV geometry, including microseismic monitoring, strain monitoring using low-frequency distributed acoustic sensing fiber optics, or reservoir pressure monitoring using permanent bottomhole pressure gauges in off-set wells. The stimulation of Injection Well 34A-22 and Production Well 34-22 produced a significant number of microseismic events which detected with a favorable signal-to-noise ratio on multiple permanent fiber optic cables. The highest quality events from both treatments are shown in FIGS. 12A-12B. The merged data from the vertical and horizontal fibers significantly improves the confidence of the event locations. The measurements of axial strain along the fibers imply that there is inherent uncertainty in the event location, particularly in the horizontal directions. The distribution of the microseismic events provides information on the extent and geometry of the SRV.

FIG. 13A-13B shows the distribution of microseismic events away from the horizontal doublet and with depth. The distribution in FIG. 13A may be generated by rotating microseismic clouds to 10 degrees to the north, accounting for the well azimuth, and stacking the events for all stages. The zero point corresponds to the middle in between 34A-22 and 34-22, the locations of which are indicated with dash-dotted lines. For the plot in FIG. 13B, event depths may be used directly. The total number of observed high-quality events in the bins of 100 ft may be calculated. To define SRV boundaries, bins which have more than 100 events for either of the stimulation treatments may be selected. Microseismic-derived SRV length may include 2,300 ft and height may include 2,500 ft. A low-frequency indicates that the half-length is more than 800 ft, and the top half-height of 400 ft is from the middle point between the injector and producer.

The horizontal well EGS concept described herein may be used to enhance reservoir permeability during the stimulation treatment phase by creating a distributed network of fractures along the wellbores. Fracture propagation occurs during the stimulation phase and acts to connect the wells hydraulically, and proppant that is pumped with the treatment fluid ultimately acts to preserve the fracture conductivity throughout the subsequent production phase. For a horizontal well doublet system connected by a set of uniform vertical fractures, flow in the fractured reservoir system between the wells can be characterized using Darcy's Law according to Equation 5:

$$q = \frac{kA}{\mu}\frac{\Delta p}{\Delta L} \qquad \text{Equation 5}$$

In Equation 5, q is volumetric flow rate, k is the permeability of the fractures, A is the total cross-sectional area of the fracture system, μ is reservoir fluid viscosity, Δp is pressure drop across the reservoir (i.e., the difference in bottomhole pressure between the injection and production well), and ΔL is the offset spacing between the wells. Assuming that the wells are connected by a set of n vertical fractures, each with fixed height h and aperture w, Equation 5 can be rewritten in terms of the fracture properties as Equation 6:

$$q = \frac{nkwh}{\mu}\frac{\Delta p}{\Delta L} \qquad \text{Equation 6}$$

Equation 6 is a measure of the overall flow capacity of the system. Equations 5-6 assume that the matrix permeability is negligible and that flow occurs primarily through the fractures. Phase 1 of a crossflow test was designed as a pressure interference test in which fluid was injected into Injection Well 34A-22 at a constant rate of approximately 10 bpm while Production Well 34-22 and Monitoring Well 73-22 were maintained in a shut-in condition. The pressure transients were observed at all three wells during the constant-rate injection period. After 42 hours of injection, Injection Well 34A-22 was shut-in and pressure falloff was monitored at all wells. Prior to starting the test, both wells were in static conditions. The reservoir fluid, initial wellbore fluid, and injectate were similar fluids, which can be classified as low-salinity brine with total dissolved solids (TDS) levels below 5000 ppm and non-condensible gas (NCG) content below 0.5% weight fraction. Therefore, fluid properties may be assumed to be similar to freshwater. Based on static temperature profiles measured along the laterals of both horizontal wells as well as a bottomhole temperature gauge installed in Monitoring Well 73-22, the average initial reservoir temperature is estimated to be 363 F. A nearly instantaneous pressure response may occur at the offset wells, indicating a highly permeable fractured reservoir system. After approximately 5 to 10 hours of constant-rate injection, pseudo-steady-state pressure transient behavior was established. A fixed pressure differential between Injection Well 34A-22 and Production Well 34-22 of approximately 205 psi occurred consistently throughout the test period. Pressure throughout the Phase 1 constant-rate injection test was measured at the injector and producer wellheads. The test was performed at a relatively low flow rate of 10 bpm. Injection temperatures varied between 75 to 125F. The downhole temperature profile was monitored along Injection Well 34A-22 continuously using DTS measurements, giving an accurate downhole fluid temperature measurements throughout the test. The frictional pressure drop was estimated while injecting fluid through 7" casing (150F bottomhole temperature) to be approximately 55 psi using standard assumptions for pipe flow, which allows for correcting for bottomhole pressure at Injection Well 34A-22. Production Well 34-22 was shut-in during the entire test, and therefore the wellhead pressure change is approximately equal to the bottomhole reservoir pressure change (e.g., there was no frictional pressure drop in the production well during this test). In the plug-and-perf stimulation treatment designed used, it is assumed that a single fracture zone initiates at each perforation cluster. Following the stimulation treatment program, a total of 102 perforation clusters were created along Injection Well 34-22 at an average spacing of 30 ft, and 94 perforation clusters were created along Production Well 34-22 at an average spacing of 30 ft. In-well distributed fiber optic sensing measurements recorded during the 34A-22 stimulation treatment suggested that fracture initiation occurred at 100% of the perforation clusters with an average flow uniformity index of about 70%.

Figure 14:
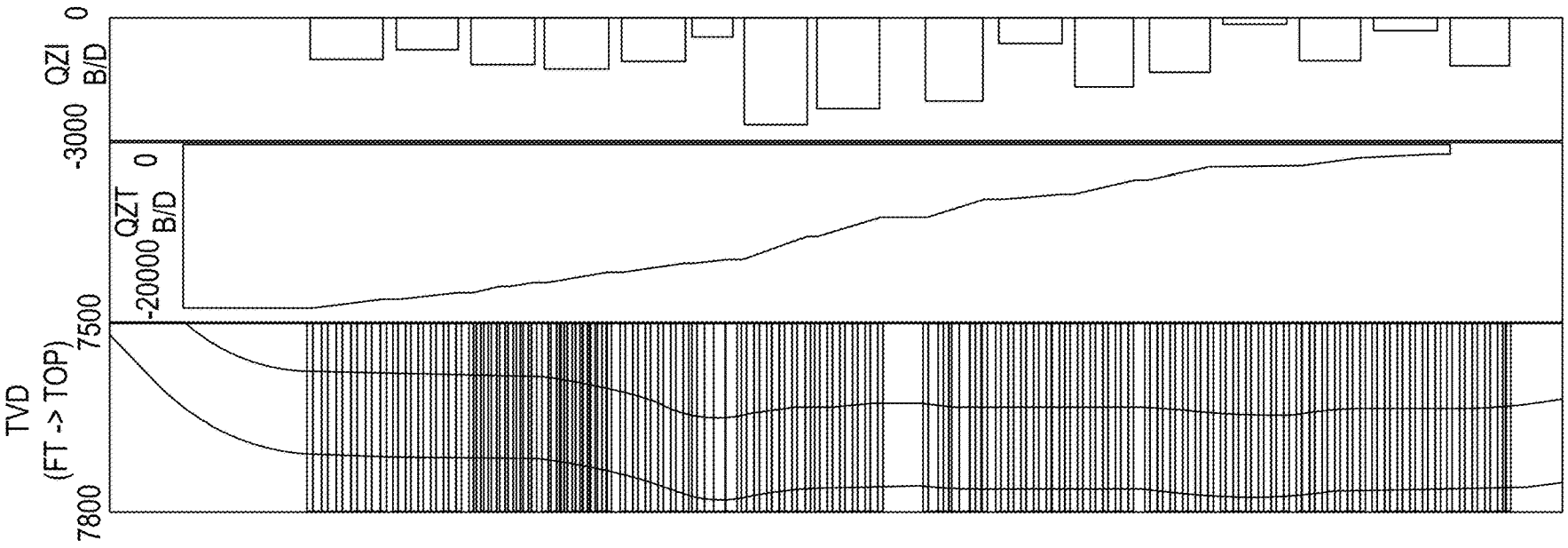
FIG. 14 illustrates an injection flow profile spinner log survey recorded in an injection well during a crossflow test, in accordance with some examples.

FIG. 14 illustrates an injection flow profile spinner log survey recorded in Injection Well 34A-22 during a crossflow test, in accordance with some examples. The flow profile image shows stage level injection rate allocation (top), a continuous record of total flow along the lateral (middle), and the lateral geometry and location of all perforation clusters along the lateral (bottom). The flow profile was measured using a spinner log that was tractored along the lateral while injecting at a flow rate of 12.5 bpm.

Several wireline spinner surveys were performed in Injection Well 34A-22 during Phase 7 of the crossflow test to measure the flow distribution along the lateral. In FIG. 14, the flow distribution is shown while injecting at 12.5 bpm, similar to the injection rate during Phase 1 of the test. The flow was not perfectly uniform but fluid flow was distributed along the entire lateral. There was no significant heel bias (e.g., flow predominantly exited the wellbore within the heel-most stages of the lateral). There were no indications that flow localized into a small subset of zones, confirming that the stimulation treatment design did not result in significant fast flowing pathways that could lead to thermal short-circuiting during long-term operations. Based on the combination of the flow allocation measurements recorded using distributed fiber optic sensing during the stimulation treatment and the flow profile surveys recorded during the crossflow test, most fracture zones along the lateral actively contribute conductivity to the EGS system.

The bottomhole pressure differential while flowing at q=10 bpm was calculated as $\Delta P$=151 psi. The average offset spacing between Injection Well 34A-22 and Production Well 34-22 was $\Delta L$=365 ft as calculated from the wellbore surveys. The effective fracture height was assumed to be h=300 ft, which is a conservative fraction of the SRV fracture height interpreted from low-frequency DAS and microseismic monitoring. The reservoir fluid viscosity was assumed to be $\mu$=0.3 cp based on an average between the initial reservoir temperature (363F) and the injected fluid temperature at bottomhole conditions (approximately 150F). The total number of active fracture pathways is assumed to range from n=75 to n=100 to account for uncertainty on the flow distribution along the wellbores and connectivity throughout the reservoir. A summary of the key reservoir and fluid properties used in the analysis are listed in Table 2 below.

TABLE 2

Properties used to evaluate reservoir transmissibility and fracture conductivity.

| Parameter | Value | Unit |
|---|---|---|
| q | 10 | bpm |
| h | 300 | ft |
| $\mu$ | 0.3 | cp |
| $\Delta p$ | 151 | psi |
| $\Delta L$ | 365 | ft |
| n | 75-100 | — |

Based on these data and measurements, the total reservoir transmissibility of the horizontal EGS system or the effective propped fracture conductivity may be estimated. The reservoir transmissibility in the example reservoir described herein was Y=0.07 bpm per psi (25.5 L/s per MPa). Depending on the assumed number of flowing fracture pathways, this transmissibility equates to an individual fracture conductivity of 300 md-ft to 400 md-ft ($9.1\times10^{-14}$ $m^3$ to 1.2×10-13 $m^3$). Under commercial operating conditions, 20 bpm to 30 bpm may be circulated through a reservoir system. In this example, 300 to 450 psi of pressure drop may occur across the reservoir, which is manageable with standard injection pump and artificial lift equipment. In other example EGS designs, the lateral length may be extended to 5000 ft to 7500 ft. Reservoir transmissibility scales linearly with lateral length and the number of fracture zones, and by increasing the lateral length the pressure drive across the reservoir may be reduced, wider offset well spacing may be enabled, or significantly higher flow rates may be enable, each of which may dramatically improve system performance.

Figure 15:
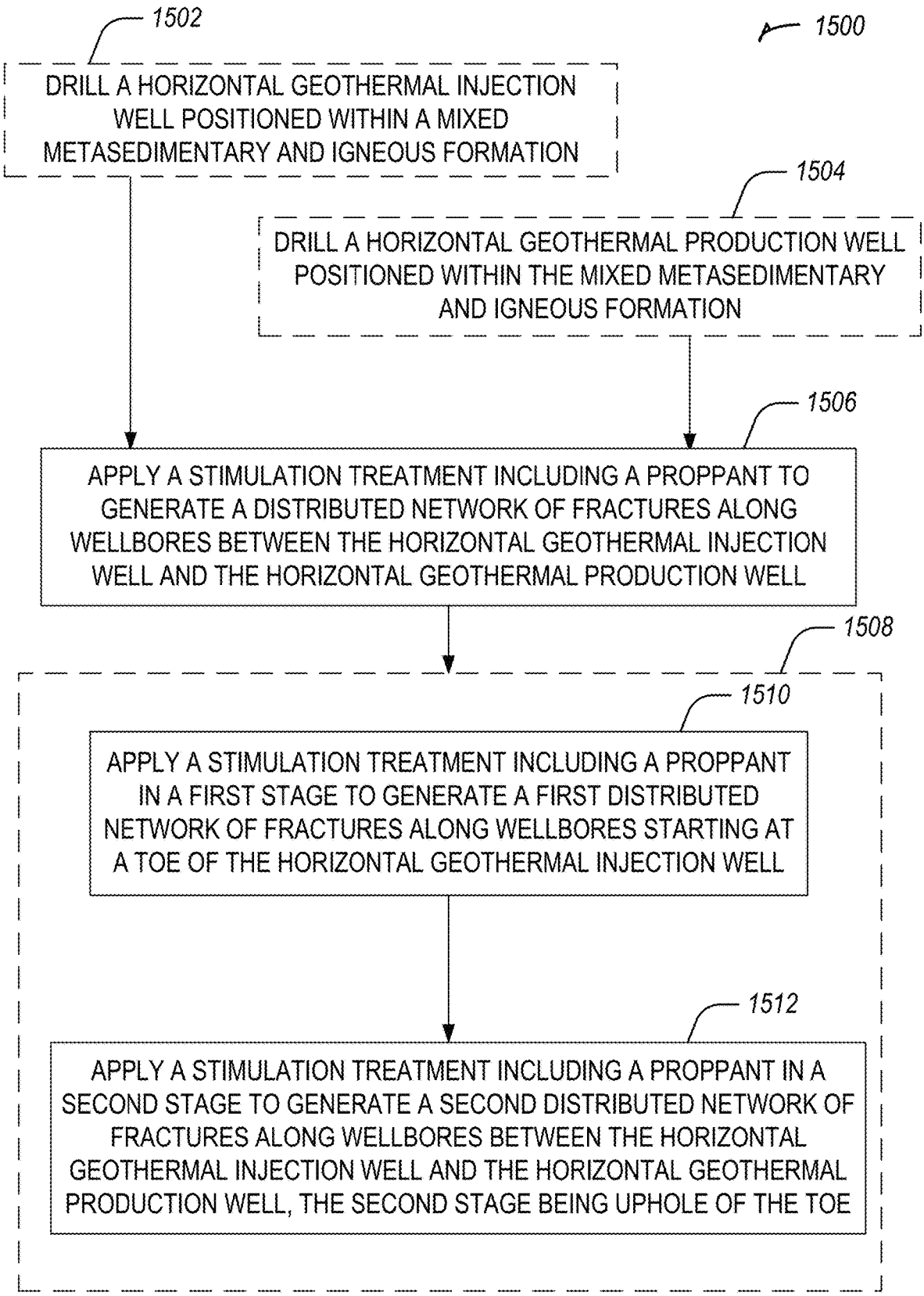
FIG. 15 illustrates a flowchart showing a technique for generating an enhanced geothermal system (EGS), in accordance with some examples.

FIG. 15 illustrates a flowchart showing a technique for generating an enhanced geothermal system (EGS), in accordance with some examples.

The technique 1500 includes an optional operation 1502 to drill a horizontal geothermal injection well positioned within a mixed metasedimentary and igneous formation.

The technique 1500 includes an optional operation 1504 to drill a horizontal geothermal production well positioned within the mixed metasedimentary and igneous formation.

The technique 1500 includes an operation 1506 to apply a stimulation treatment including a proppant to generate a distributed network of fractures along wellbores between the horizontal geothermal injection well and the horizontal geothermal production well. The stimulation treatment may be a is a multistage, multicluster stimulation treatment. The stimulation treatment may occur in stages starting at a toe of the horizontal geothermal injection well and sequentially moving uphole toward a heel of the horizontal geothermal injection well. The stimulation treatment may occur according to a plug-and-perforate design. Operation 1506 may include pumping a slurry of fluid and proppant down the wellbores and through perforations in the horizontal geothermal injection well to initiate fractures.

Operation 1506 may include a set of suboperations 1508 including an operation 1510 and an operation 1512.

Operation 1510 to includes Applying a stimulation treatment including a proppant in a first stage to generate a first distributed network of fractures along wellbores starting at a toe of the horizontal geothermal injection well.

Operation 1512 to includes applying a stimulation treatment including a proppant in a second stage to generate a second distributed network of fractures along wellbores between the horizontal geothermal injection well and the horizontal geothermal production well, the second stage being uphole of the toe.

In an example, a stage may include a stage length of 100 feet to 300 feet. In some examples, a stage may include a plurality of discrete zones that are perforated.

The technique 1500 may include performing a crossflow production test including a steady-state performance test, and outputting a result of the crossflow production test. The result may include a response time in a first well based on a change in a second well.

Example 1 is an enhanced geothermal system (EGS) comprising: a horizontal geothermal injection well positioned within a mixed metasedimentary and igneous formation; a horizontal geothermal production well positioned within the mixed metasedimentary and igneous formation; and a distributed network of fractures along wellbores between the horizontal geothermal injection well and the horizontal geothermal production well, the distributed network of fractures generated via a stimulation treatment comprising a proppant.

In Example 2, the subject matter of Example 1 includes, wherein the EGS is operable without use of an artificial lift.

In Example 3, the subject matter of Examples 1-2 includes, wherein the stimulation treatment is a multistage, multicluster stimulation treatment.

In Example 4, the subject matter of Examples 1-3 includes, wherein the stimulation treatment occurs in stages starting at a toe of the horizontal geothermal injection well and sequentially moving uphole toward a heel of the horizontal geothermal injection well.

In Example 5, the subject matter of Example 4 includes, wherein the stimulation treatment occurs according to a plug-and-perforate design.

In Example 6, the subject matter of Examples 4-5 includes, wherein the stages comprise a stage length of 100 feet to 300 feet.

In Example 7, the subject matter of Examples 4-6 includes, wherein each stage within the stages comprises a plurality of discrete zones that are perforated.

In Example 8, the subject matter of Examples 1-7 includes, wherein the stimulation treatment comprises pumping a slurry of fluid and proppant down the wellbores and through perforations in the horizontal geothermal injection well to initiate fractures.

Example 9 is a method for generating an enhanced geothermal system (EGS), the method comprising: drilling a horizontal geothermal injection well positioned within a mixed metasedimentary and igneous formation; drilling a horizontal geothermal production well positioned within the mixed metasedimentary and igneous formation; and applying a stimulation treatment comprising a proppant to generate a distributed network of fractures along wellbores between the horizontal geothermal injection well and the horizontal geothermal production well.

In Example 10, the subject matter of Example 9 includes, wherein the stimulation treatment is a multistage, multicluster stimulation treatment.

In Example 11, the subject matter of Examples 9-10 includes, wherein the stimulation treatment occurs in stages starting at a toe of the horizontal geothermal injection well and sequentially moving uphole toward a heel of the horizontal geothermal injection well.

In Example 12, the subject matter of Example 11 includes, wherein the stimulation treatment occurs according to a plug-and-perforate design.

In Example 13, the subject matter of Examples 11-12 includes, wherein the stages comprise a stage length of 100 feet to 300 feet.

In Example 14, the subject matter of Examples 11-13 includes, wherein each stage within the stages comprises a plurality of discrete zones that are perforated.

In Example 15, the subject matter of Examples 9-14 includes, wherein applying the stimulation treatment comprises pumping a slurry of fluid and proppant down the wellbores and through perforations in the horizontal geothermal injection well to initiate fractures.

In Example 16, the subject matter of Examples 9-15 includes, performing a crossflow production test comprising a steady-state performance test, and outputting a result of the crossflow production test.

Example 17 is a method for generating an enhanced geothermal system (EGS), the method comprising: applying a stimulation treatment comprising a proppant in a first stage to generate a first distributed network of fractures along wellbores starting at a toe of a horizontal geothermal injection well positioned within a mixed metasedimentary and igneous formation, the first distributed network of fractures occurring between the horizontal geothermal injection well and a horizontal geothermal production well positioned within the mixed metasedimentary and igneous formation; and applying a stimulation treatment comprising a proppant in a second stage to generate a second distributed network of fractures along wellbores between the horizontal geothermal injection well and the horizontal geothermal production well, the second stage being uphole of the toe of the horizontal geothermal injection well.

In Example 18, the subject matter of Example 17 includes, wherein the stimulation treatment occurs according to a plug-and-perforate design.

In Example 19, the subject matter of Examples 17-18 includes, wherein the first stage comprises a stage length of 100 feet to 300 feet.

In Example 20, the subject matter of Examples 17-19 includes, wherein the first stage and the second stage each comprise a plurality of discrete zones that are perforated.

Example 21 is an apparatus comprising means to implement of any of Examples 1-20.

Example 22 is a system to implement of any of Examples 1-20.

Example 23 is a method to implement of any of Examples 1-20.

Method examples described herein may be machine or computer-implemented at least in part. Some examples may include a computer-readable medium or machine-readable medium encoded with instructions operable to configure an electronic device to perform methods as described in the above examples. An implementation of such methods may include code, such as microcode, assembly language code, a higher-level language code, or the like. Such code may include computer readable instructions for performing various methods. The code may form portions of computer program products. Further, in an example, the code may be tangibly stored on one or more volatile, non-transitory, or non-volatile tangible computer-readable media, such as during execution or at other times. Examples of these tangible computer-readable media may include, but are not limited to, hard disks, removable magnetic disks, removable optical disks (e.g., compact disks and digital video disks), magnetic cassettes, memory cards or sticks, random access memories (RAMs), read only memories (ROMs), and the like.

What is claimed is:

1. An enhanced geothermal system (EGS) comprising:

a horizontal geothermal injection well positioned within a formation;

a horizontal geothermal production well positioned within the formation; and a distributed network of fractures along wellbores between the horizontal geothermal injection well and the horizontal geothermal production well, the distributed network of fractures comprising a set of uniform vertical fractures connecting the horizontal geothermal injection well and the horizontal geothermal production well, each uniform vertical fracture of the set of uniform vertical fractures having a uniform height and a uniform aperture, fluid flow being evenly distributed along the distributed network of fractures, each uniform vertical fracture of the set of uniform vertical fractures contributing to conductivity of the EGS, and the distributed network of fractures generated via a stimulation treatment comprising a proppant.

2. The EGS of claim 1, wherein the formation is a mixed metasedimentary and igneous formation, and the EGS is operable without use of an artificial lift.

3. The EGS of claim 1, wherein the stimulation treatment is a multistage, multicluster stimulation treatment.

4. The EGS of claim 1, wherein the stimulation treatment occurs in stages starting at a toe of the horizontal geothermal injection well and sequentially moving uphole toward a heel of the horizontal geothermal injection well.

5. The EGS of claim 4, wherein the stimulation treatment occurs according to a plug-and-perforate design.

6. The EGS of claim 4, wherein the stages comprise a stage length of 100 feet to 300 feet.

7. The EGS of claim 4, wherein each stage within the stages comprises a plurality of discrete zones that are perforated.

8. The EGS of claim 1, wherein the stimulation treatment comprises pumping a slurry of fluid and proppant down the wellbores and through perforations in the horizontal geothermal injection well to initiate fractures.

9. A method for generating an enhanced geothermal system (EGS), the method comprising:

drilling a horizontal geothermal injection well positioned within a formation;

drilling a horizontal geothermal production well positioned within the formation; and applying a stimulation treatment comprising a proppant to generate a distributed network of fractures along wellbores between the horizontal geothermal injection well and the horizontal geothermal production well, the distributed network of fractures comprising a set of uniform vertical fractures connecting the horizontal geothermal injection well and the horizontal geothermal production well, each uniform vertical fracture of the set of uniform vertical fractures having a uniform height and a uniform aperture, fluid flow being evenly distributed along the distributed network of fractures, and each uniform vertical fracture of the set of uniform vertical fractures contributing to conductivity of the EGS.

10. The method of claim 9, wherein the formation is a mixed metasedimentary and igneous formation, and the stimulation treatment is a multistage, multicluster stimulation treatment.

11. The method of claim 9, wherein the stimulation treatment occurs in stages starting at a toe of the horizontal geothermal injection well and sequentially moving uphole toward a heel of the horizontal geothermal injection well.

12. The method of claim 11, wherein the stimulation treatment occurs according to a plug-and-perforate design.

13. The method of claim 11, wherein the stages comprise a stage length of 100 feet to 300 feet.

14. The method of claim 11, wherein each stage within the stages comprises a plurality of discrete zones that are perforated.

15. The method of claim 9, wherein applying the stimulation treatment comprises pumping a slurry of fluid and proppant down the wellbores and through perforations in the horizontal geothermal injection well to initiate fractures.

16. The method of claim 9, further comprising performing a crossflow production test comprising a steady-state performance test, and outputting a result of the crossflow production test.

17. A method for generating an enhanced geothermal system (EGS), the method comprising:

applying a stimulation treatment comprising a proppant in a first stage to generate a first distributed network of fractures along wellbores starting at a toe of a horizontal geothermal injection well positioned within a formation, the first distributed network of fractures occurring between the horizontal geothermal injection well and a horizontal geothermal production well positioned within the formation, the first distributed network of fractures comprising a set of uniform vertical fractures connecting the horizontal geothermal injection well and the horizontal geothermal production well, each uniform vertical fracture of the set of uniform vertical fractures having a uniform heigh and a uniform aperture, fluid flow being evenly distributed along the distributed network of fractures, and each uniform vertical facture of the set of uniform vertical fractures contributing to conductivity of the EGS; and applying the stimulation treatment comprising the proppant in a second stage to generate a second distributed network of fractures along wellbores between the horizontal geothermal injection well and the horizontal geothermal production well, the second stage being uphole of the toe of the horizontal geothermal injection well.

18. The method of claim 17, wherein the formation is a mixed metasedimentary and igneous formation, and the stimulation treatment occurs according to a plug-and-perforate design.

19. The method of claim 17, further comprising:

calculating a flow capacity of the EGS based on a total cross-sectional area of the first distributed network of fractures, the total cross-sectional area being determined using a number of uniform vertical fractures in the set of uniform vertical fractures, the uniform height, and the uniform aperture.

20. The method of claim 17, wherein the first stage and the second stage each comprise a plurality of discrete zones that are perforated.

* * * * *